US006718706B2

(12) United States Patent
Katz

(10) Patent No.: US 6,718,706 B2
(45) **Date of Patent: *Apr. 13, 2004**

(54) ENTRYWAY PROTECTOR

(76) Inventor: Edward R. Katz, 20 W. Ridge Ct., SE., Cartersville, GA (US) 30121

( * ) Notice: Subject to any disclaimer, the term of this patent is extended or adjusted under 35 U.S.C. 154(b) by 121 days.

This patent is subject to a terminal disclaimer.

(21) Appl. No.: 10/090,678

(22) Filed: Mar. 5, 2002

(65) Prior Publication Data

US 2002/0174613 A1 Nov. 28, 2002

Related U.S. Application Data

(63) Continuation-in-part of application No. 09/695,885, filed on Oct. 25, 2000, now Pat. No. 6,381,910.

(51) Int. Cl.[7] ..... E04B 1/344
(52) U.S. Cl. ..... 52/211; 52/741.3; 52/3
(58) Field of Search ..... 52/211, 741.3, 52/2.12, 3

(56) References Cited

U.S. PATENT DOCUMENTS 1,126,243 A * 1/1915 McQuown ..... 410/118
1,719,364 A * 7/1929 Gilkey ..... 27/19
5,813,172 A * 9/1998 McNally ..... 52/2.25
6,381,910 B1 * 5/2002 Katz ..... 52/211

* cited by examiner

*Primary Examiner*—Carl D. Friedman
*Assistant Examiner*—Basil Katcheves
(74) *Attorney, Agent, or Firm*—Thomas, Kayden, Horstemeyer & Risley, L.L.P.

(57) ABSTRACT

The present invention is a protection device for use with elevator doorjamb panels and entryway doors and jambs to protect the surfaces of these panels and doors from sustaining damage from collisions with moving equipment, building materials and furniture. The device protects the surfaces from scratches and dents when furniture and construction materials inadvertently bang into these protected surfaces. The entryway protector includes two sections and a securing system. A main rectangular section may be separated by a line of stitching from a minor rectangular section. The main rectangular section comprises a cushioning material and a rigid sheet. Both sections can be placed in a protective material. The securing system can secure the protector to the surfaces against dislodging by contact with equipment, building materials and furniture.

18 Claims, 4 Drawing Sheets

ENTRYWAY PROTECTOR

This is a continuation-in-part application of U.S. patent application Ser. No. 09/695,885 filed Oct. 25, 2000, now U.S. Pat. No. 6,381,910.

BACKGROUND OF THE INVENTION

1. Field of the Invention

The present invention relates to a protective device for protecting exposed entryways and doors from the inadvertent contact and possible damage by furniture, equipment, construction materials and the like being moved.

2. Description of Related Art

The relocation industry employs numerous devices and methods in order to provide the quickest, safest and most inexpensive move possible for their clients. Moving companies and related industries constantly develop, test and refine innovative products so that such a move is possible. For example, moving companies often utilize lifting devices that are easily movable through constricted spaces, such as door frames. These lifting devices can safely secure a heavy load and allow just a single person to navigate the load in and out of buildings. These devices also reduce the risk of injury to movers.

A typical office mover employs several individuals to load and unload furniture on and off moving equipment or move the furniture by hand. The moving equipment typically is pushed or pulled through the office, through the office doors, in to an elevator, out of the elevator, and through the building's front doors. This procedure is repeated, in reverse, to move the furniture into the new office space. Throughout this moving process, edges and corners of, for example, a hand truck or the furniture can inadvertently come in contact with walls, doors, and jambs, not only damaging the moving equipment and furniture, but also the walls, doors and jamb surfaces. Similar to the moving process described above, customized construction in an office space can pose a similar risk to both the moving equipment and building materials, and the surfaces of the building's wall, doors and jambs. The expense of repairing damaged walls, doors and door jambs typically falls upon the building owner, the landlord or building management. Thus, movers and contractors rarely bring to the site protective pads to place minimize such damage to buildings to maintain a quality reputation. Thus, movers and contractors utilize moving equipment designed to avoid this type of damage.

One such product is the Spider Crane® used by Office Moving Systems of Atlanta, Georgia. The Spider Crace® lifts full lateral files high enough to roll a specially designed steel dolly underneath the files. While the cabinet is held safely suspended, a member of the moving crew slides the steel dolly underneath the cabinet, which is then gently lowered. This type of device not only reduces injuries, but also enables the client to minimize down time since the Spider Crane® lifts a full file cabinet. Thus, the client need not unload the cabinets and pack the files in boxes. The proper use of this type of device also reduces the expense to the moving company of patching and painting walls damaged by moving the cabinets through the office versus when cabinets are moved in more traditional ways, such as by a two-wheel dolly or hand truck, where there is less control over the cabinets while they are moved in and out of the buildings.

Even with the best of care, there is always the risk of damage to property during the moving process. Damage is not confined to the items and products being moved, but can also be sustained by the office or residential structure itself which can be banged, dinged or scratched by the items or the moving equipment such as dollies and hand trucks. The transportation of construction materials through a building passageway also can cause damage, specifically damaging areas of narrowing in the passageway, which are typically at doorways and elevators. An inadvertent scrape can damage the paint, wallpaper and other building surface material.

Superior barrier-type protection devices are disclosed in U.S. patent application Ser. No. 09/695,885, which application is fully incorporated herein by reference. The invention of that application comprises two sections and a securing component. A main rectangular section is separated by a vertical line of stitching from a smaller section, or minor rectangular flap. The minor flap is further provided with a vertical line of stitching forming two minor flap components. Both the main section and the minor flap are also provided with at least one horizontal line of stitching. The vertical and horizontal lines of stitching provide fold lines for the device.

With the manufacture and use of these devices, it was noted that certain modifications of the principal design could be improved on, for example, that the main section could include both cushioning material and rigid sheet and that the minor flap itself did not need to be vertically foldable. Therefore, it can be seen that there is a need in the art for lightweight, easily constructed, inexpensive, noninvasive and portable barrier-type device that can protect building surfaces.

BRIEF SUMMARY OF THE INVENTION

Briefly described, in its preferred form, the present invention comprises a barrier device for use with elevator door jamb panels and entryway doors and jambs to protect the surfaces of these panels and doors from sustaining damage from collisions with moving equipment, building materials and furniture. The present invention is a protection device placed against the at-risk wall or door surfaces. The device protects the surfaces from scratches and dents when furniture and construction materials inadvertently bang into these protected surfaces.

The present entryway protector is a barrier-type device that a landlord or property manager can quickly and easily install both to protect the elevator jamb panels and the sidewalls of the adjacent elevator hallway, and to protect open door from scratches and dents. The invention comprises two sections and a securing component. A main rectangular section can be separated from the minor section by a vertical line of stitching. The vertical and horizontal lines of stitching provide fold lines for the device.

The main section is composed of two materials, one of these materials is cushioning material that protects the sidewall or an open door from scratches and dents, the other material is a rigid material that prevents furniture or building material being moved from penetrating the entryway protector and damaging the door or sidewall. The cushioning material absorbs the shock from furniture or building material hitting the entryway protector.

The main section preferably comprises the cushioning material and rigid material enclosed within a protective sleeve of thick vinyl. The minor flap preferably comprises a cushioning material enclosed within a protective sleeve of thick vinyl. The securing component is capable of releasable securing the protection device to the at-risk surface. It should be realized that the entryway protector does not need a protective cover, although it is preferred.

In applications where the present invention is placed at the entrance of an elevator, the entryway protector is placed so that the minor flap folds along a perpendicular edge of the main section. The minor flap is placed in contact with, and is hung against, the jamb panel in proximity to the elevator door using a securing component. Preferably, the minor flap is hung on the jamp panel using suction cups. The jamb panels in proximity to the elevator door typically have one of the two possible widths, approximately seven or fourteen inches. The minor flap is designed to be the necessary width needed to protect the doorjamb.

The vertical line of stitching between the main section and the minor flap is preferably aligned with the corner edge of the door jamb panel and the hallway wall in which the elevator is set. The main section extends along a portion of the length of the hallway wall from the corner edge, away from the elevator. In this configuration, both the jamp panel of the elevator and a length of the hallway wall are protected from contact with moving equipment, construction materials and furniture.

In another application, the protector can "hug" an open door, so the door can remain open while protected from construction materials or furniture moving in and out of the entrance. In this embodiment, the securing component for the main section and minor section can comprise loop and hook fasteners combined with straps extending from the main section to secure the protector around the door. In this manner, the door is hugged and secured snug by the protector. The protector is held in place by inserting the straps through the spaces between the hinges of the door, which are then secured to the minor flap.

The cushioning material in the main section is placed adjacent to the wall or open door being protected so that any furniture or building materials hitting the entryway protector will first hit the rigid sheet, which will prevent the sharp portion of the furniture or building materials from penetrating the entryway protector. The cushioning material will absorb the shock of anything hitting the entryway protector.

The main section of the present invention is capable of remaining upright without any wall attachment because the main section has both a sufficiently thick bottom edge surface to support it in the upright position, and rigidity from the rigid sheet enclosed within the protective sleeve of thick vinyl. It has been found that if the main section comprises a cushioning pad and rigid sheet of approximately three-inch thickness, the main section will remain upright against the surface. Velcro® strips can be provided on the horizontal fold lines along the width of the main section to help in holding the main section upright against the surface. The minor flap preferably comprises a cushioning pad of approximately one-inch thickness. When the minor flap of the present invention is hung against the elevator jamb panel by a securing component, both panels remain upright, and thus stay in place even when contacted by furniture or equipment.

Other features of the present invention include its economical cost, its ease of carrying as it can be folded about both the vertical and horizontal lines of stitching, and the ease in which the device fits snug around a door and is supported near an elevator. Further, unlike furniture pads, the present invention remains in the upright position so the protection device does not crumple to the floor. In order to use furniture pads to protect the hallway walls, hanging attachments must be secured into the wall, which attachments necessarily damage the wall. Conversely, the present invention is noninvasive.

Thus, it is an object of the present invention to provide a lightweight, portable and inexpensive protection device to protect wall and door surfaces from collision with furniture, moving equipment and construction materials.

It is another object of the present invention to provide a protection device that can be easily moved and placed in position by one individual.

It is a further object of the present invention to provide a protection device comprising a padded main section with a rigid sheet with a minor flap.

These and other objects, features and advantages of the present invention will become more apparent upon reading the following specification in conjunction with the accompanying drawing figures.

DETAILED DESCRIPTION OF A PREFERRED EMBODIMENT

Figure 1:
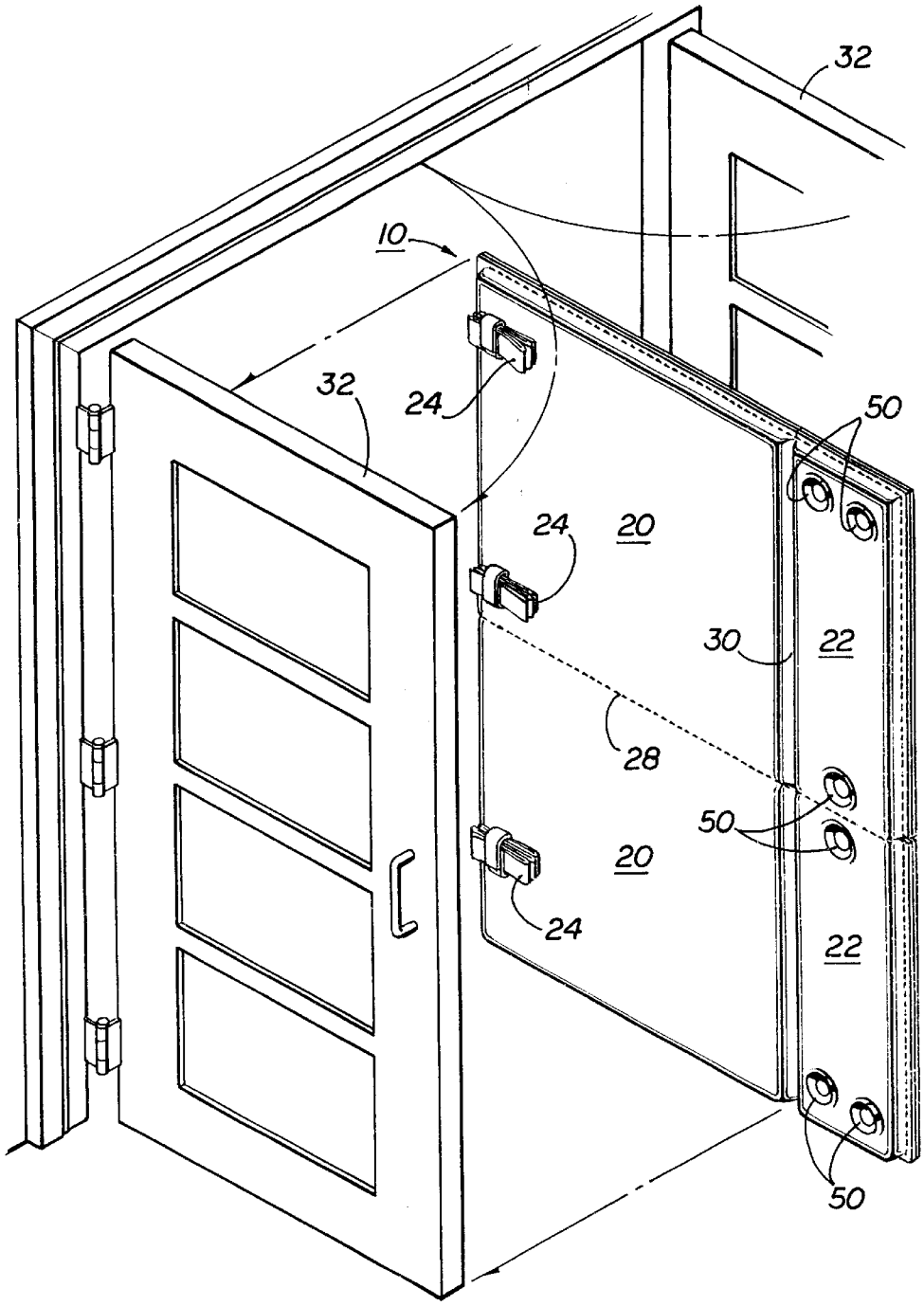
FIG. 1 is a front view of an entryway protection device according to a preferred embodiment of the present invention, which is ready for hanging on a door.
Figure 4:
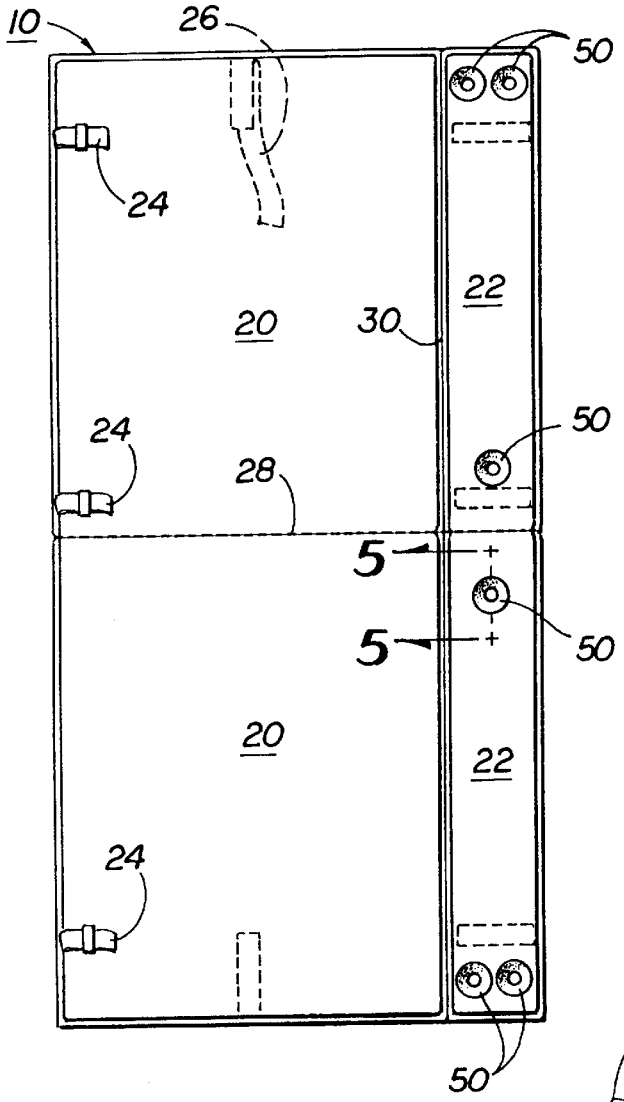
FIG. 4 is a front view of the entryway protection device according to a preferred embodiment of the present invention.

Referring now in detail to the drawing figures, wherein like reference numerals represent like parts throughout the several views, FIG. 1 and FIG. 4 show a front view of a preferred embodiment of the present entryway protector 10. Preferably, the entryway protector 10 comprises a main section 20, a minor flap 22 and securing components 24. The entryway protector can be provided with a handle strap 26 for carrying as shown in FIG. 4. The entryway protector 10 has a horizontal fold line 28 which facilities folding the entryway protector for ease of carrying. A vertical fold line 30 separates the main section 20 from the minor flap 22 so that the entryway protector 10 can be folded around a door or placed in the jamb of an elevator doorway.

Figure 6:
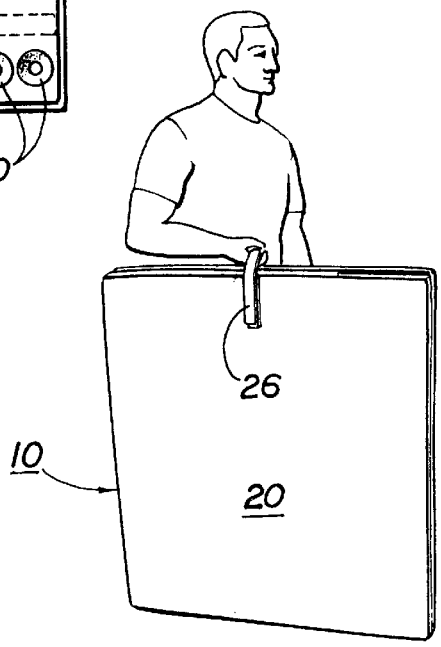
FIG. 6 is a perspective view of an entryway protection device that has been folded and being carried by a person.

The entryway protector 10 can be folded along vertical fold line 30 allowing the minor flap 22 to be in juxtaposition with the main section 20. The entryway protector 10 can then be folded along horizontal fold line 28 and carried by handle strap 26 as illustrated in FIG. 6.

Figure 2:
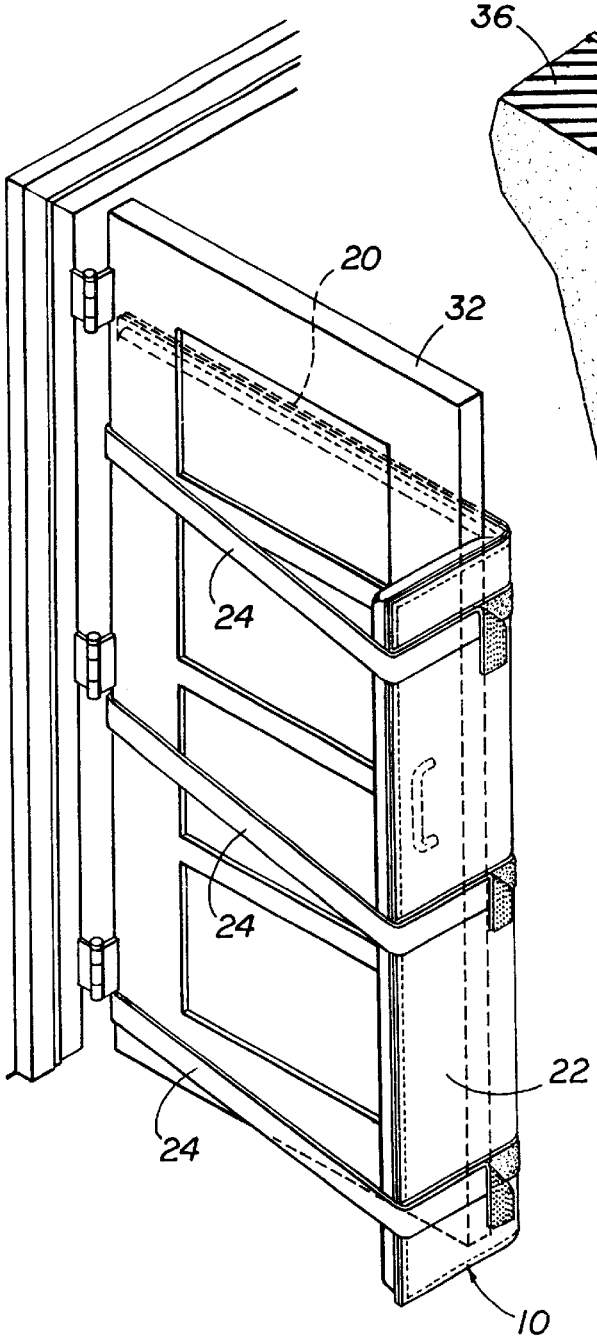
FIG. 2 is a perspective view of the entryway protection device of this invention protecting an open door.

FIG. 2 illustrates the entryway protector 10 of this invention secured to a door 32 by securing component 24 which can be a simple strap or belt. It will be noticed that the main section 20 is secured to that portion of the door that faces the entryway when the door is open to allow furniture or building materials to be moved through the entryway.

Figure 3:
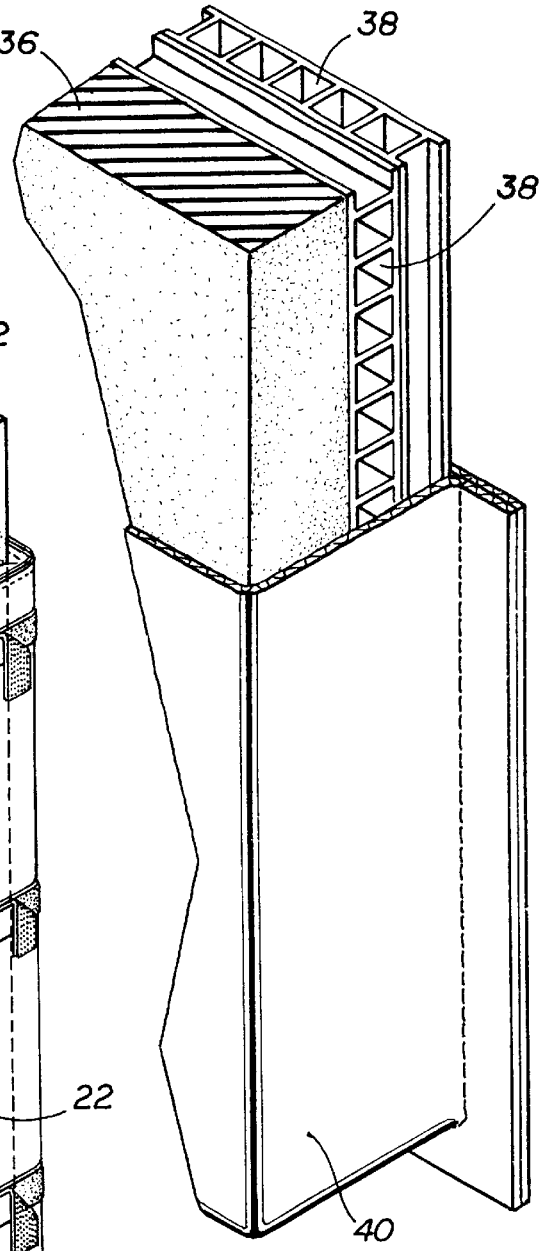
FIG. 3 is a partial cross sectional view of the main section of an entryway protection device of this invention.

As illustrated in FIG. 3, the main section 20 may be composed of a cushioning material 36 and two rigid sheets 38. The rigid sheets help protect the door or wall from denting or being penetrated by furniture or building materials being moved. A single layer of rigid sheet may be used, but two sheets obviously provide more protection and strength. The cushioning material 36 absorbs the force of furniture or building material hitting the entryway protector 10. The entryway protector may have a thick vinyl cover 40.

Figure 5:
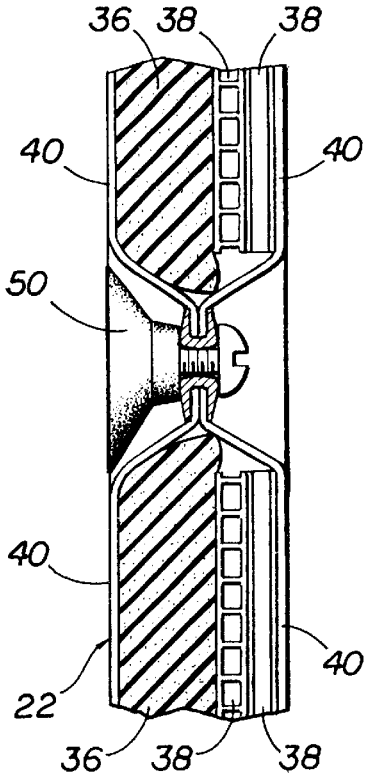
FIG. 5 is a cross sectional view taken along lines 4—4 of FIG. 1 of the minor flap of the entryway protection device of this invention.

A cross sectional view of the minor flap.22 is illustrated in FIG. 5 which has the cushioning material 36 and rigid sheets 38. A suction cup 50 for holding the minor flap 22 to a door jamp is shown. The cushioning material 36 can be foam, rubber, plastic, or any other satisfactory cushioning material. The rigid sheet 38 can be constructed of wood or plastic, preferably a corrugated plastic that helps absorb the stress, such as Corrplas®, may be utilized. If two sheets of corrugated plastic such as Corrplas®, are used, the ribs of the sheets can be run perpendicular to each other for increased strength. It may be necessary to have a top and bottom sheet for the main section 20 so it can be folded or hinged so it can be folded along the fold horizontal fold line 28.

The entryway protector 10 can also be composed of the cushioning material alone on the minor flap 22 and cushioning material 36 and rigid sheet on the main section 20. It is preferable to have both cushioning material and rigid sheet 38 also on the minor flap 22. Preferably, the cushioning material 36 and rigid sheet 38 are enclosed in a thick vinyl cover 40. The cover 40 can be integral for both the main section 20 and the minor flap 22 or be composed of two separate covers. The cushioning material 36 and rigid sheets 38 in the main section 20 may be as much as three inches in thickness to provide the desired protection. In that case, there will be a thick edge between the top and the bottom portions of the main section 20. The minor flap 22 may also have a significant thickness if two rigid sheets are used with the cushioning material.

The edge between the top and bottom portions of the main section 20 can have two strips attached to the edge, one with a hook and the other with a loop (Velcro®) to assist in holding the main section 20 upright against a wall when the entryway protector is used to protect the door jam and wall adjacent to an elevator. The cover 40 for the main section 20 and minor flap 22 is preferably made of a puncture resistant material, such as vinyl and like to protect against the furniture and building materials that hit the entryway protector 10. The main section 20 and minor flap 22 are preferably rectangular but can easily incorporate a variety of shapes and sizes depending on the configuration of the surface to be protected. Preferably, the main section 20 and minor flap 22 are approximately 6'8" in height and three inches thick. The main section is approximately 2'8" in length.

The minor flap 22 can be attached to the main section 20 along vertical fold line 30 by a line of stitching. This line of stitching enables the minor flap 22 to rotate independently of main section 20. The minor flap 22 can be secured to main section 20 by a number of other well-known methods other than by a line of stitching. The minor flap 22 does not need to be as thick as the main section 20. It can be, for example, approximately one-inch thick if it is composed of cushioning material only.

Figure 7:
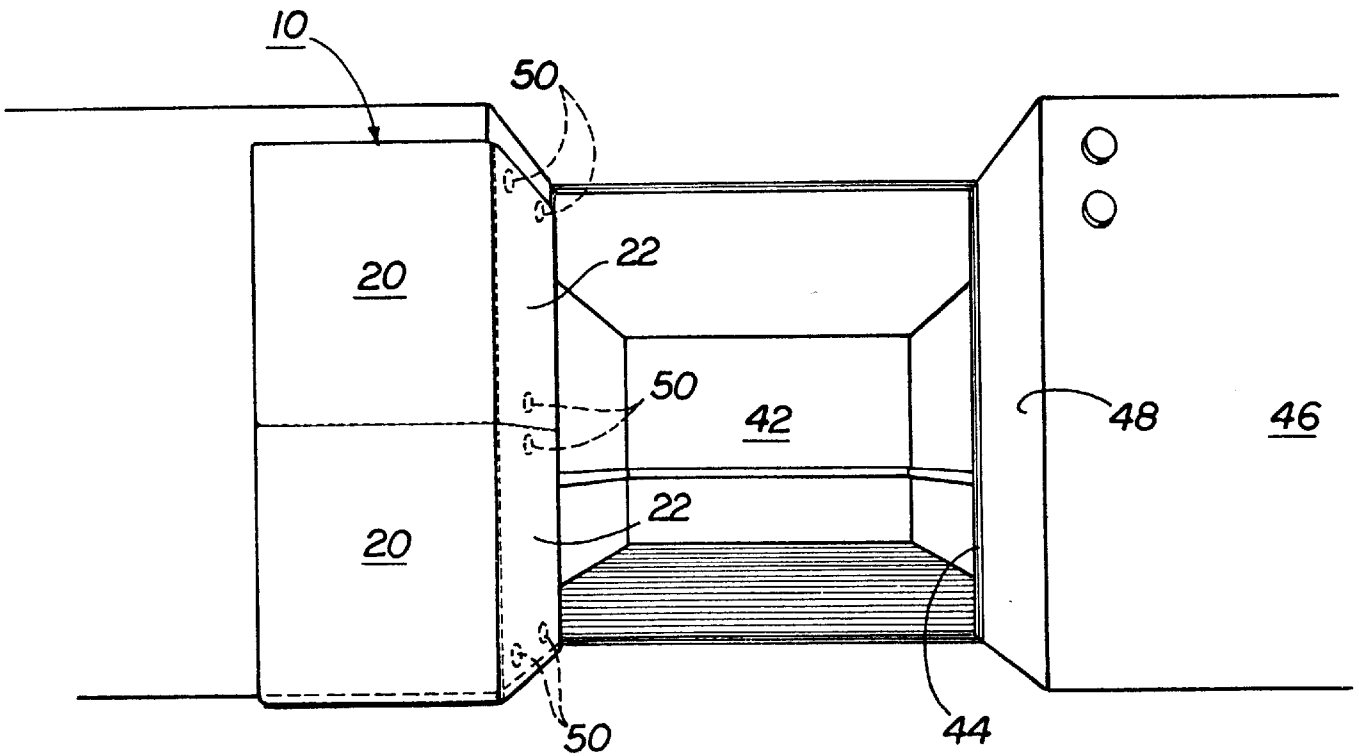
FIG. 7 is a perspective view of the present invention protecting the elevator jamb and the adjacent hallway on one side of an elevator.

As illustrated in FIG. 7, the entryway protector 10 is especially useful for protecting the door jambs and walls adjacent to the elevator. The elevator 42 includes elevator door 44 set back from hallway walls 46. Elevator jamb panels 48 span the set back depth of the elevator doors 44 from the hallway wall 46. These elevator jamb panels 48 are especially prone to damage from moving objects in and out of elevator 42. The width of the elevator jamb panels is typically either seven inches or fourteen inches and the entryway protector 10 can have a minor flap 22 with a width of the appropriate distance needed. Generally, hallway walls 46 are perpendicular to elevator jamb panels 48; however, the entryway protector because of its construction works equally as well with acute or obtuse corners.

As illustrated in FIG. 7, the entryway protector 10 is placed as a protective barrier over hallway wall 46 and jamb panel 48 to protect the surfaces from construction and the like passing through elevator doors 44. In this application, the main section 20 is left free standing against length of the hallway wall 46. The thickness of the main section 20 enables it to remain upright without attaching the main section 20 to hallway wall 46. Thus, hallway wall 46 remains free of distracting holes necessary to provide a hanging assembly for the conventional mat or pad.

The entryway protector 10 wraps around the corner between the hallway wall 46 and the elevator jamb panel 48 so that the minor flap 22 rests over jamb panel 48. The minor flaps 22 preferably have the same width as the width of the jamb panel 48.

The minor flap 22 may not have a significant thickness or rigidity to remain upright without being releasable secured to jamb panel 48. Thus, in one embodiment of the present entryway protector 10 the minor flap 22 is supplied with suction cups 50 attached by a bolt. These suction cups can then be secured to the jamb panel 48. The suction cups 50 can be easily detached when the entryway protector 10 is removed.

Thus, the entryway protector 10 protects portions of hallway wall 46 and elevator jamb panel 48 in proximity to elevator 42. It would be understood that entryway protector 10 can similar protect the hallway and jamb panel of an in ordinary door. The entryway protector 10 is easily hung by one individual without any way damaging the hallway wall 46 or elevator jamb panel 48.

While the invention has been disclosed in its preferred forms, it will be apparent to those skilled in the art that many modifications, additions, and deletions can be made therein without departing from the spirit and scope of the invention and its equivalents as set froth in the following claims.

What is claimed:

1. A portable device for protecting the surfaces of an entryway from moving objects there through, the entryway having a first and a second surface, the device comprising:

(a) a main section with the main protection material comprising a cushioning material and two rigid sheets in juxtaposition having a main horizontal fold line with a sheet on each side of the horizontal fold line, the main section capable of protecting the first surface with the cushioning material and rigid sheets, the entryway protector being designed to be placed immediately adjacent to the first surface so that the rigid sheet is first contacted by any moving object to restrain penetration of the portable device and the cushioning material being designed to absorb the force exerted by the moving object;

(b) a minor flap composed of a cushioning material rotatably connected to the main section, the minor flap having a minor horizontal fold line, the minor flap having a width such that the minor flap is capable of protecting a distance of the width of the second surface; and (c) a noninvasive securing system capable of securing the device to the surfaces to be protected;

the main section and minor flap capable of being foldable about the main and minor horizontal fold lines, respectively, providing portability to the device.

2. The device of claim 1, for protecting an elevator jamb panel and a proximate hallway wall, the jamb panel and the proximate hallway meeting at a corner and being at an angle from each other, the device being foldable about the corner wherein the main section protects a portion of the hallway wall, and the minor flap protects a portion of the jamb panel.

3. The device of claim 1, wherein the entryway is a door rotatably connected to a doorway, the device being foldable about the width of the door, wherein the main section protects one side of the door, and the minor flap protects the other side of the door.

4. The device of claim 1, wherein the main section has two rigid sheets on each side of the horizontal fold line in juxtaposition to each other.

5. The device of claim 4, in which each rigid sheet is ribbed with the ribs on sheets in juxtaposition to each other being perpendicular to each other.

6. The device of claim 4, wherein the minor flap has two rigid sheets on each side of the horizontal fold line in juxtaposition to each other.

7. The device of claim 6, in which each rigid sheet is ribbed with the ribs on the sheets in juxtaposition to each other being perpendicular to each other.

8. The device of claim 1, wherein the main section is thicker than the minor flap.

9. The device of claim 1, wherein the main horizontal fold line is contiguous with the minor horizontal fold line.

10. The device of claim 9, wherein the main section further comprises a main protective sleeve enclosing the main protection material.

11. The device of claim 10, wherein the minor section further comprises a minor protective sleeve enclosing the minor protection material.

12. The device of claim 11, wherein the main protective sleeves is constructed of the same material as the minor protective sleeve.

13. The device of claim 1, wherein the main horizontal fold line has an adjacent detachable securing system assisting in holding the main section in an upright position when in use.

14. The device of claim 13, wherein the detachable securing system consists of two strips one with a series of loops and other with a series of projections that are designed to be inserted between the loops that are readily detachable by pulling.

15. The device of claim 1, wherein the securing system comprises at least one belt and fastener for the belt, said belt being capable of extending around at least the main section.

16. The device of claim 1, wherein the securing system comprises at least one suction cup.

17. The device of claim 16, in which the suction cup is attached to the minor flap by a fastener extending through a grommet in the minor flap.

18. The device of claim 17, in which the securing system also includes a plurality of belts and fasteners for the belts, said belts being capable of extending horizontally around the main section and minor flap.

* * * * *